US009637296B1

(12) United States Patent
Corvisier

(10) Patent No.: US 9,637,296 B1
(45) Date of Patent: May 2, 2017

(54) PACKAGING FOR USE IN THE SHIPPING OF ARTICLES

(71) Applicant: JF Hillebrand Limited, Dublin (IE)

(72) Inventor: Pierre Corvisier, Beaune (FR)

(73) Assignee: JF Hillebrand Limited, Dublin (IE)

( * ) Notice: Subject to any disclaimer, the term of this patent is extended or adjusted under 35 U.S.C. 154(b) by 0 days.

(21) Appl. No.: 15/414,529

(22) Filed: Jan. 24, 2017

Related U.S. Application Data

(62) Division of application No. 14/493,191, filed on Sep. 22, 2014.

(30) Foreign Application Priority Data

Dec. 3, 2013 (GB) ..... 1321311.1

(51) Int. Cl.
*B65D 81/02* (2006.01)
*B65D 81/05* (2006.01)
(Continued)

(52) U.S. Cl.
CPC ..... *B65D 81/052* (2013.01); *B65D 55/02* (2013.01); *A45C 13/021* (2013.01); *B65D 81/03* (2013.01)

(58) Field of Classification Search
CPC ..... B65D 55/02; B65D 81/03; B65D 81/052; A45C 13/021
(Continued)

(56) References Cited

U.S. PATENT DOCUMENTS 4,569,082 A * 2/1986 Ainsworth ..... A45C 13/021 150/106
4,801,213 A * 1/1989 Frey ..... B65D 81/052 206/522
(Continued)

FOREIGN PATENT DOCUMENTS

EP 1 939 110 A1 7/2008
JP S5735275 U 2/1982
(Continued)

OTHER PUBLICATIONS

European Patent Office, European Search Report, dated Sep. 25, 2015, issued in Application No. EP 14185086.7.
(Continued)

*Primary Examiner* — Luan K Bui
(74) *Attorney, Agent, or Firm* — Klarquist Sparkman, LLP

(57) ABSTRACT

A liner for protecting two articles, stacked or side-by-side, comprises panels each of which consists of inflated tubes. The panels provide protection for the top, bottom and sides of both articles. Where the articles are stacked there is a panel between the top of the lower article and the bottom of the upper article. Where the articles are side-by-side there is a panel between the adjacent side surfaces of the two articles. A shipping container is also disclosed which comprises a liner having side wall panels, a lid and a base. Each panel comprises a number of parallel side-by-side tubes. There is an air manifold to which the tubes are connected and an air valve through which air for inflating the panels can be introduced. The liner fits snugly in an outer enclosure which is rigid or is a soft bag. A stiff inset sheet in the bag and against its base imparts rigidity to it. The lid is secured along one of its edges to the walling of the bag and there is a sliding clasp fastener along the edges of the lid and the top
(Continued)

edge of the walling for releasably securing the other three edges of the lid to the side walling.

8 Claims, 8 Drawing Sheets

(51) Int. Cl.
*B65D 55/02* (2006.01)
*B65D 81/03* (2006.01)
*A45C 13/02* (2006.01)

(58) Field of Classification Search
USPC ..... 206/522, 591–594; 383/3
See application file for complete search history.

(56) References Cited

U.S. PATENT DOCUMENTS

| | | | | |
|---|---|---|---|---|
| 5,445,274 | A | 8/1995 | Pharo | |
| 5,469,966 | A * | 11/1995 | Boyer | B65D 31/14 206/522 |
| 5,769,232 | A * | 6/1998 | Cash | B65D 81/052 206/522 |
| 6,431,361 | B1 | 8/2002 | Wolf | |
| 7,584,848 | B2 | 9/2009 | Yoshifusa | |
| 8,728,595 | B1 | 5/2014 | Liao | |
| 2002/0064318 | A1 * | 5/2002 | Malone | B65D 81/052 383/3 |
| 2002/0081041 | A1 * | 6/2002 | Malone | B29C 65/18 383/3 |
| 2006/0021897 | A1 * | 2/2006 | Dickinson | B65D 5/4233 206/521 |
| 2006/0207849 | A1 * | 9/2006 | Sadow | A45C 7/0081 190/18 A |
| 2006/0280913 | A1 | 12/2006 | Yoshida | |
| 2007/0051655 | A1 | 3/2007 | Yoshifusa | |
| 2007/0090013 | A1 | 4/2007 | Yoshifusa | |
| 2007/0221530 | A1 | 9/2007 | Lee | |
| 2008/0193055 | A1 | 8/2008 | Chen | |
| 2009/0050509 | A1 | 2/2009 | Liao | |
| 2010/0124636 | A1 | 5/2010 | Gibson | |
| 2013/0048529 | A1 * | 2/2013 | Liao | B65D 31/00 206/522 |
| 2013/0270145 | A1 | 10/2013 | Takenaka | |
| 2014/0224699 | A1 * | 8/2014 | Smith | B65B 5/06 206/522 |

FOREIGN PATENT DOCUMENTS

| | | |
|---|---|---|
| JP | H05 16671 U | 3/1993 |
| JP | H0811939 A | 1/1996 |
| WO | WO 97/20756 | 6/1997 |
| WO | WO 00/15514 | 3/2000 |
| WO | WO 2006/012077 A2 | 2/2006 |
| WO | WO 2007/047774 A2 | 4/2007 |
| WO | WO 2010/030713 A2 | 3/2010 |

OTHER PUBLICATIONS

United Kingdom Intellectual Property Office, Search Report, dated Mar. 25, 2014, issued in Application No. GB1321311.1.

* cited by examiner

FIG 2
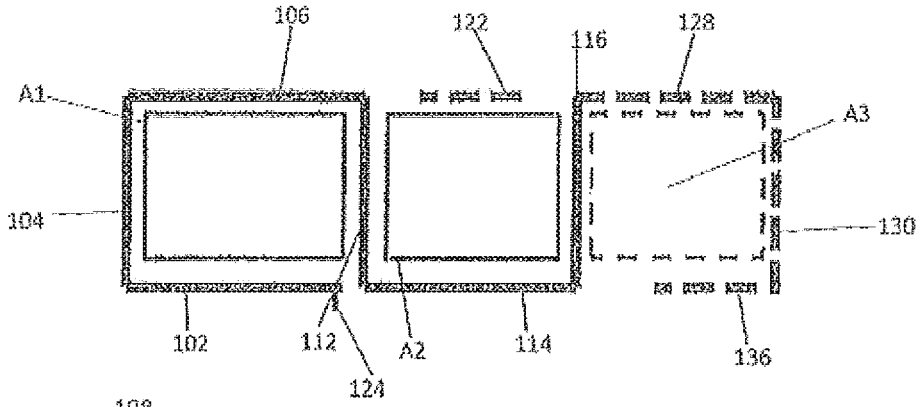
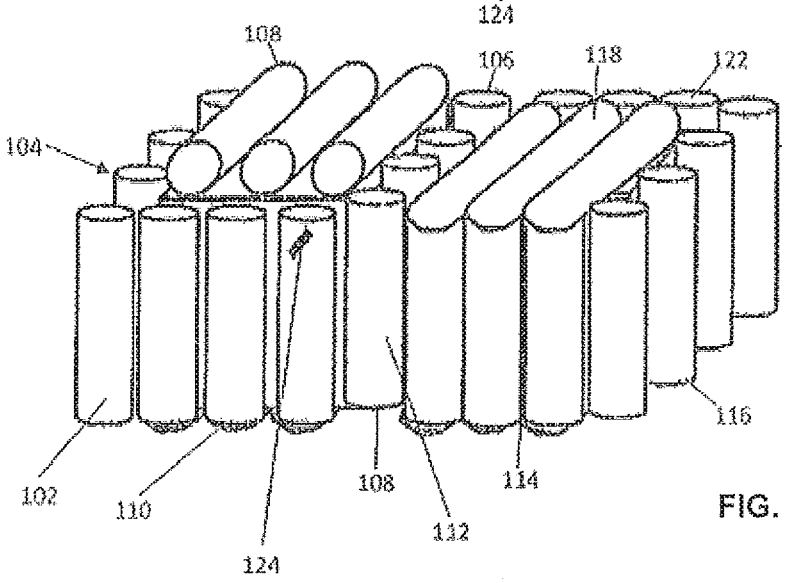
FIG. 3

FIG. 8
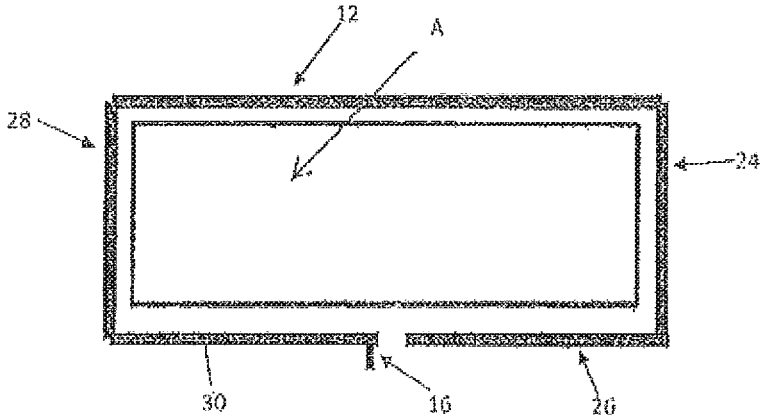
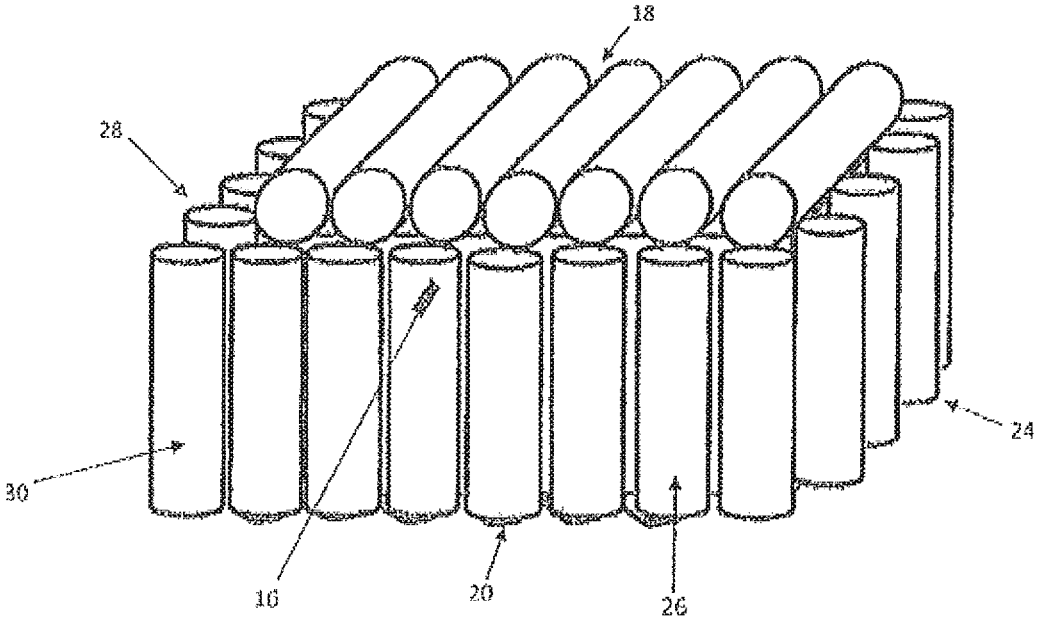
FIG. 9

PACKAGING FOR USE IN THE SHIPPING OF ARTICLES

CROSS REFERENCE TO RELATED APPLICATIONS

This is a division of application Ser. No. 14/493,191, filed Sep. 22, 2014, which claims the benefit of United Kingdom Patent Application No. 1321311.1, filed Dec. 3, 2013, the disclosures of both of which are incorporated herein in their entireties by reference.

FIELD OF THE INVENTION

This invention relates to packaging for use in the shipping of articles.

BACKGROUND TO THE INVENTION

It is necessary carefully to protect fragile and expensive articles which are to be shipped across the world, usually from a supplier to a customer. Expensive wines are an example of the type of fragile goods of high value that fall in this category.

European patent specification EP 1 939 110, PCT specifications WO 2010/030713, WO97/20756, WO2007/047774 and WO0/15514, US 2013/0048529 and 2006/0280913 and Japanese specifications JP H0811939 and JP55735275 are examples of specifications which disclose protective liners which are used in the shipping of articles.

The present invention provides a shipping liner which provides superior mechanical and thermal protection for articles that are surrounded by the liner.

BRIEF DESCRIPTION OF THE INVENTION

According to one aspect of the present invention there is provided a protective liner for use in the shipping of articles, the liner comprising layers of synthetic plastics material welded together to provide a plurality of panels each of which is constituted by a plurality of inflatable tubes, there being a manifold to which all the tubes connect and which has an air inlet valve to enable the manifold to communicate with a source of air under pressure for the purpose of inflating the tubes, the liner comprising a first group of panels for protecting a first article to be shipped, the first group of panels consisting of a rectangular first panel which constitutes, in use, a side wall panel, a second panel protruding in one direction from one edge of the first panel and which, in use, constitutes a base panel, a third panel protruding from the opposed edge of the first panel in the opposite direction to the second panel and which, in use, constitutes a top panel, and further panels protruding from both the remaining edges of the first panel and which, in use, constitute side panels of the liner, and a second group of panels which is joined to the first group of panels and is for protecting a second article to be shipped and which is adjacent the first article, the second group of panels comprising first panel for protecting the sides of the second article, a second panels for protecting the top of the second article and a third panel for protecting the bottom of the second article, one panel being, in use, between the articles being shipped.

In one form said liner in for protecting stacked articles and includes a double height panel on each side of said rectangular first panel, the lower part of each double height panel being joined to said rectangular first panel and constituting one of said further panels of the first group, and the upper parts each constituting one of said first panels of the second group. In this form there can be a row of four panels with the first panel in the row joined to the edge of said rectangular first panel remote from the edge along which the rectangular first panel is joined to said second panel of the first group of panels, one of the panels of said row of panels being, in use, between the top of the lower article and the upper article stacked on it and the remaining three panels of said row constituting side, top and side protecting panels for the upper article.

In another form of the liner it is for protecting side-by-side articles and said third panel of the second group is joined to, and lies between, two of the first panels of the second group.

According to a further aspect of the present invention there is provided shipping container comprising a liner having a plurality of panels each of which panels is constituted by a plurality of inflatable tubes, there being a row of side wall panels which, in use, stand vertically and protect the sides of the article being shipped, a base panel on one sides of the row of panels and on which said article being shipped stands, a top panel on the opposite side of the row of panels to the base panel and which overlies the article being shipped, and an outer enclosure, comprising a base, side walling and a lid, into which said liner fits, said liner being between the article and the outer enclosure to provide thermal and mechanical protection.

Said outer enclosure is preferably in the form of a soft bag, there being a stiff sheet inserted into the lower part of the bag in contact with the base of the bag.

A further stiff sheet can be provided in the outer enclosure between the article and said top panel.

A further panel, also comprises inflatable tubes, can be provided between said top panel and said lid to take up any free space.

In this form elastic straps are preferably secured to the inside surface of the lid, said further panel having portions thereof between said lid and the straps and being held in place by the straps.

One edge of the lid can be permanently connected to the side walling and there can be a sliding clasp fastener having the stringers thereof secured to the remaining three edges of the lid and to the side walling for closing the outer enclosure.

It is preferred that releasable locking means are provided for securing the sliding clasp of the fastener to said side walling to prevent the shipping container being opened until the locking means is released.

Carrying straps can be secured to the outer enclosure.

BRIEF DESCRIPTION OF THE DRAWINGS

For a better understanding of the present invention, and to show how the same may be carried into effect, reference will now be made, by way of example, to the accompanying drawings in which;—

FIG. 2 is a diagrammatic plan view illustrating how the liner of FIG. 1 is folded to its "in use" condition;

FIG. 3 is a diagrammatic pictorial view of the liner of FIG. 1 in its "in use" condition;

FIG. 8 is a diagrammatic top plan view of the liner of FIG. 7 in its "in use" condition;

FIG. 9 is a pictorial view illustrating the liner "in use" condition;

DETAILED DESCRIPTION OF THE DRAWINGS

Figure 1:
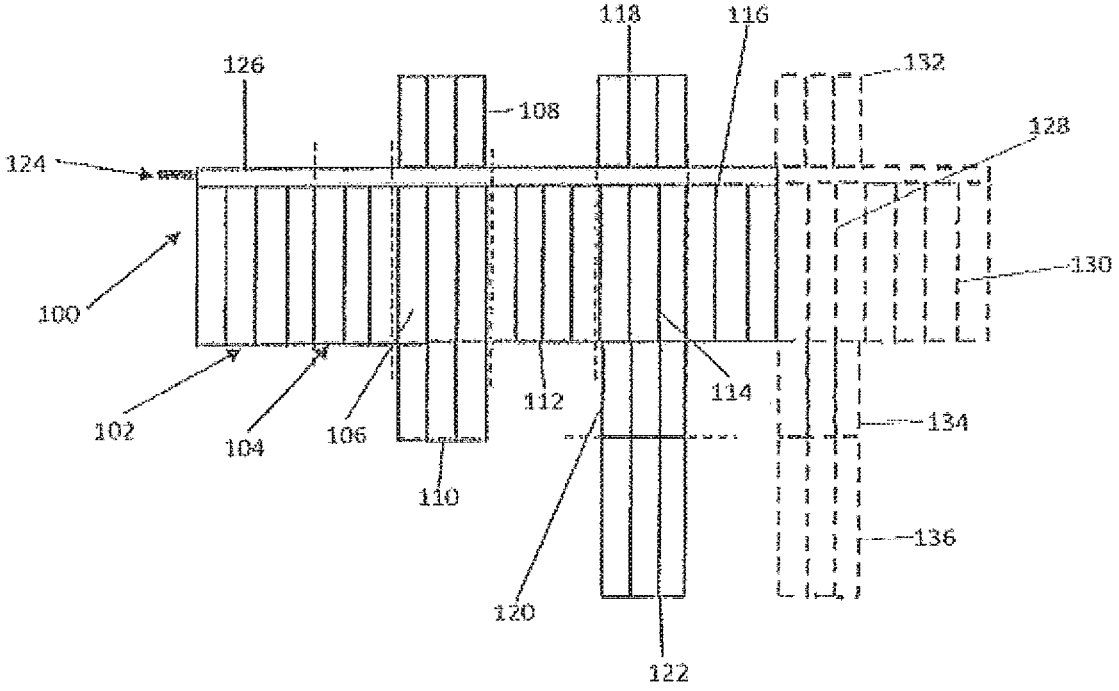
FIG. 1 is a plan view of a first form of protective liner for used in transporting articles placed side-by-side.

The liner 100 illustrated in FIGS. 1 to 3 comprises a plurality of panels each of which is constituted by a number of elongate inflatable tubes. The liner is fabricated by superimposing two sheets of synthetic plastics material and welding the sheets together to form the tubes and other constructional features of the liner.

The panels of the liner 100 are designated 102, 104, 106, 108, 110, 112, 114, 116, 118, 120 and 122. An air inlet valve is designated 124 and a manifold is designated 126. The tubes of most of the panels communicate directly with the manifold 126. The tubes of the panels 110, 120 and 122 communicate with the manifold 126 by way of the interiors of the tubes of other panels.

The diagrammatic top plan view, FIG. 2, illustrates the configuration that the panels 102, 104, 106, 112, 114 and 116 adopt to protect the sides of side-by-side articles designated A1 and A2.

The panels 108, 110 respectively protect the top and bottom of the article A1 and the panels 118, 120 protect the top and bottom of the article A2. If the liner 100 continues on beyond panel 116, as will be described, then the liner does not have a fourth side panel for protecting the article A2. In this event it is the panel 122, folded upwardly, that constitutes the fourth side panel.

The liner 100 can be extended by panels 128, 130 which enable the liner to envelope a third article designated A3 as illustrated in FIG. 2. Top and bottom panels 132, 134 extend from the panel 128. The further panel 136 has the same function as the panel 122.

Figure 4:
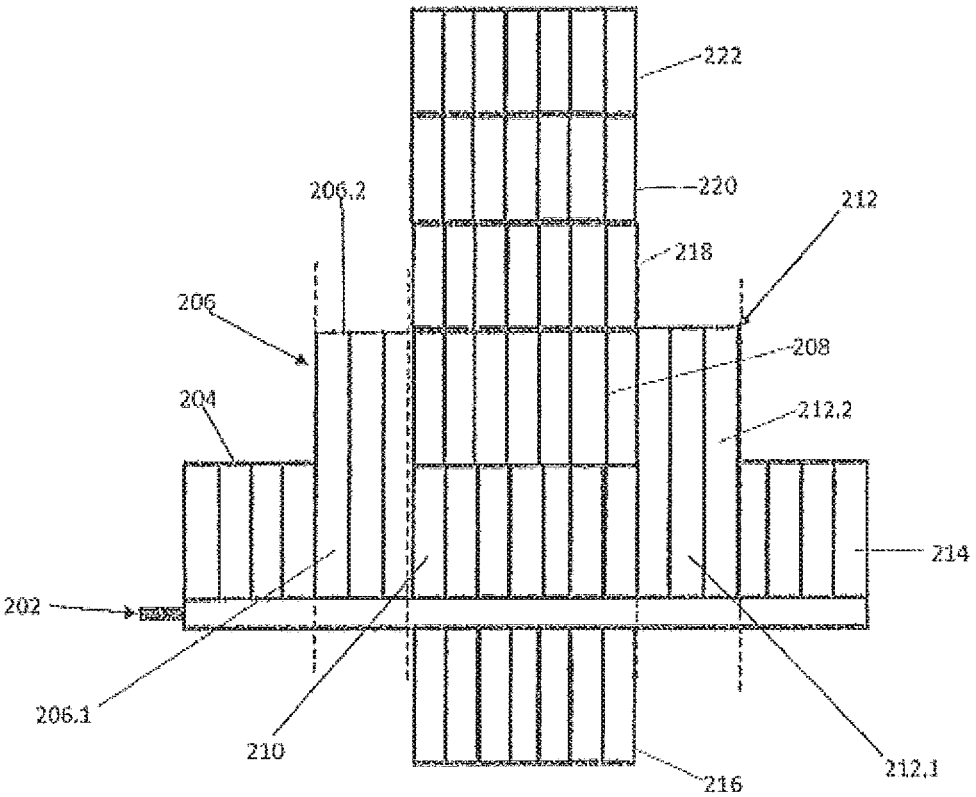
FIGS. 4, 5 and 6 correspond to FIGS. 1, 2 and 3 and illustrate a further form of liner which protects stacked articles.
Figure 5:
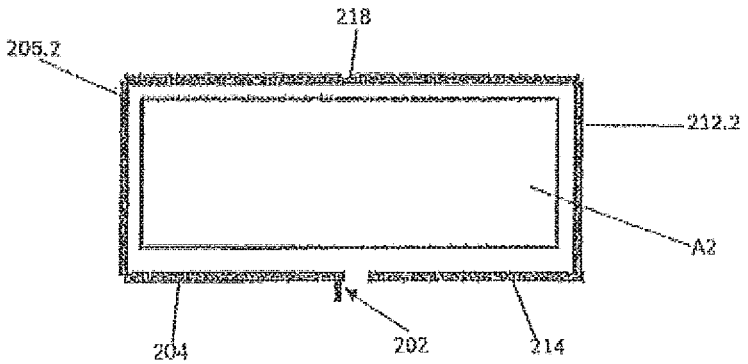
Figure 6:
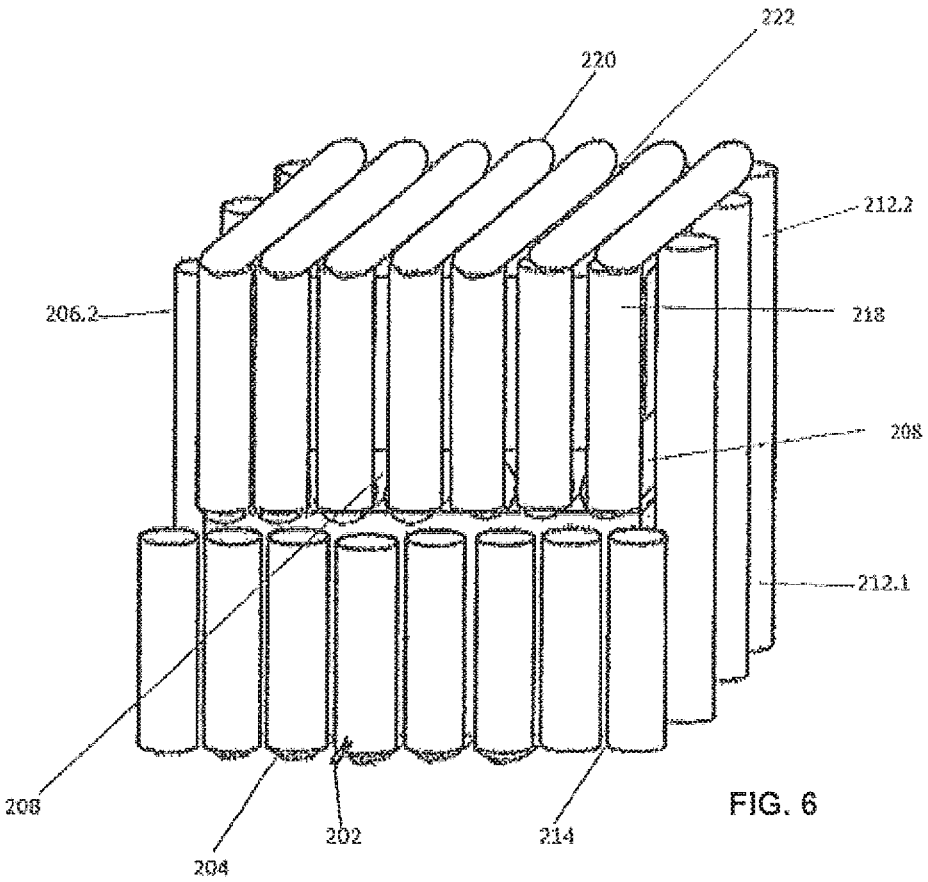

The liner 200 shown in FIGS. 4, 5 and 6 has an air inlet valve and a manifold, generally designated 202, which are the same as described above. The liner has panels which are designated 204, 206, 208, 210, 212, 214, 216, 218, 220, 222.

The panels 206 and 212 are of double height and have lower parts 206.1, 212.1 and upper parts 206.2, 212.2. The upper parts 206.2, 22.2 are not joined to the adjacent edges of the panel 208.

The lower article of the two to be protected is placed on the panel 216 and the panel 210 folded upwards to the vertical position. The panel 208 is folded over to lie horizontally on top of the lower article. An upper article A2 (FIG. 5) is then placed on the panel 208 and the panel 218 folded up to lie adjacent the side of the upper article. The panel 220 is folded over to lie on top of the upper article and the panel 222 folded down to lie adjacent the opposite side of the upper article.

The panels 204, 206, 212 and 214 are folded around to envelope of remaining sides of the upper and lower articles. The lower parts 206.1, 212.1 of the panels 206, 212 lie on opposite sides of the lower article and the upper parts 206.2, 212.2 lie on opposite sides of the upper article.

It will be understood that in FIGS. 1 to 3 the articles are adjacent in the sense that they are side-by-side. In FIGS. 4 to 5 the articles are adjacent in the sense that they are stacked.

Figure 7:
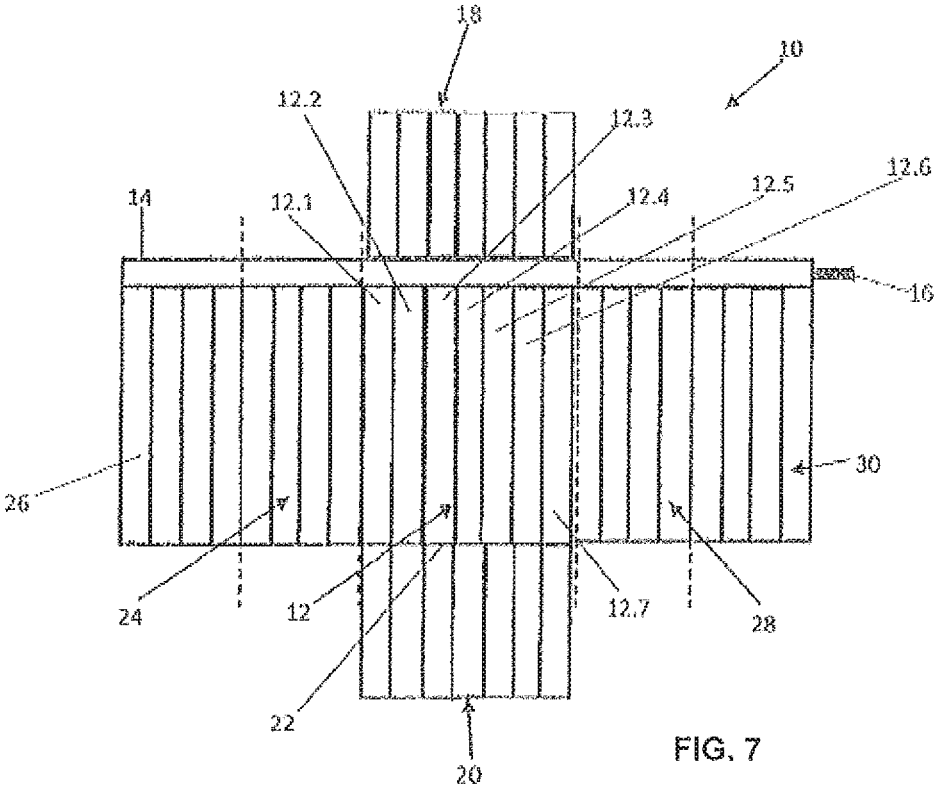
FIG. 7 is a plan view of a protective liner for used in transporting goods.

The liner 10 illustrated in FIG. 7 comprises a plurality of panels each of which is constituted by a number of inflatable pads each of which is in the form of an elongate tube. The liner is fabricated by superimposing two sheets of synthetic plastics material and welding the sheets together to form the tubes and other constructional features of the liner.

The panel designated 12 in FIG. 7 is, in use, a vertical panel which lies adjacent one face of the article A (FIG. 8) which is to be protected. The panel comprises, in the illustrated form, seven parallel tubes 12.1 to 12.7. There are weld lines between adjacent tubes 12.1 to 12.7.

At one end each tube 12.1 to 12.7 communicates with a manifold 14 which has an air inlet valve designated 16.

A second panel 18 also comprising seven parallel air filled tubes lies on the opposite side of the manifold 14 to the panel 12. One end of each tube of the panel 18 communicates with the manifold 14. Weld lines separate the tubes of the panel 18 from one another.

A panel 20, identical in shape to the panel 18, is joined to the panel 12 along a weld 22. The tubes of the panel 20 communicate, through the weld 22, with the tubes 12.1 to 12.7. This permits air to flow from the manifold 14 through the tubes 12.1 to 12.7 to the tubes of the panel 20 for the purpose of inflating these.

One of the panels 18, 20 is a base panel and the other is a top panel when the liner is in use.

Four further panels that are provided are designated 24, 26, 28 and 30. Each comprises four parallel tubes. These tubes are parallel to the tubes 12.1 etc. and each communicates at one end with the manifold 14. The broken lines in FIG. 7 indicate where bending of the liner takes place.

The liner is used by folding it along the weld line 22 so that the panel 20 is horizontal and the panel 12 stands up vertically from the weld line. The article A to be protected and shipped is then placed on the panel 20 with the panel 12 immediately adjacent one side of it (see FIG. 8).

The liner is then bent along the broken lines of FIG. 7 so that the panels 24, 26, 28 and 30 envelope the other three sides of the article A as shown in FIG. 3. The panel 18 is folded to a horizontal position to protect the top surface of the article A.

Figure 10:
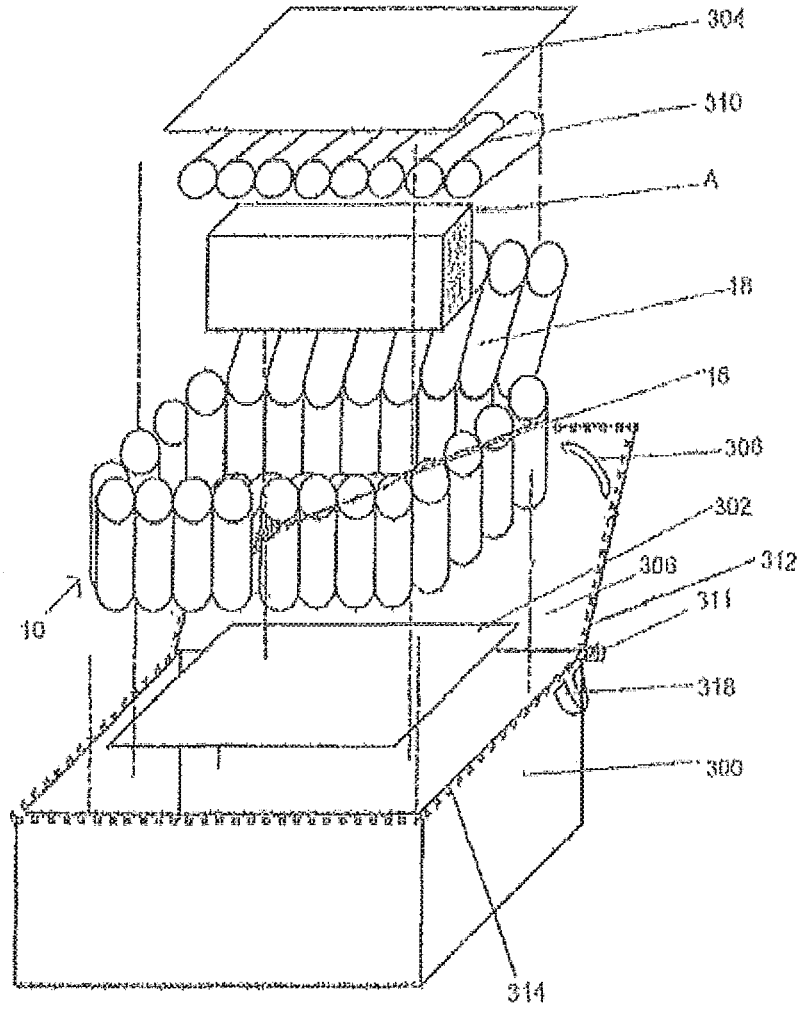
FIG. 10 is an "exploded" pictorial view of the components of a shipping container.
Figure 11:
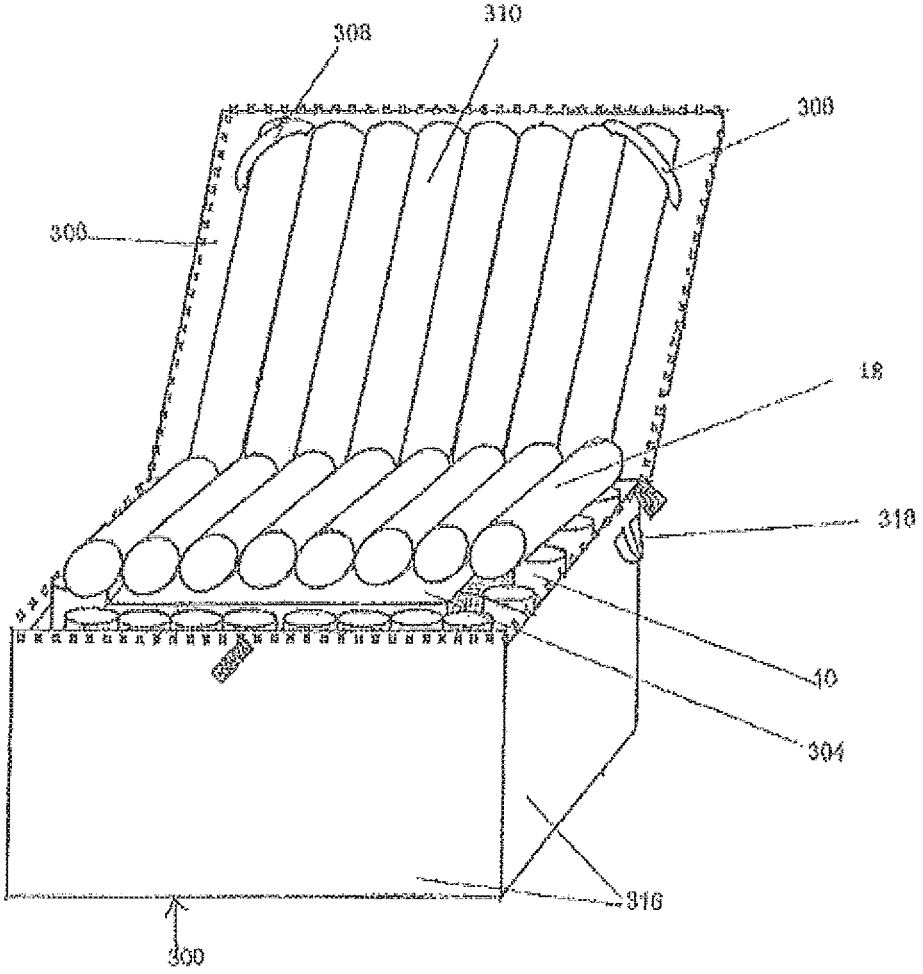
FIG. 11 illustrates the assembled shipping container prior to closure of the lid.

The shipping container illustrated in FIGS. 10 and 11 includes a protective liner 10 as illustrated in FIG. 7 which provides protection for the designated article A.

The outer enclosure of the shipping container, which provides mechanical protection and heat insulation, is designated 300 in FIGS. 10 and 11, and can be of rigid form. However, it is preferred that it be a soft bag. The bag can be fabricated using sheet synthetic plastics material. The material of the bag can be aluminised so that it reflects heat. The plastics material can be single ply or can be of laminated form.

To impart some stiffness to the base of the bag when the container comprises a soft bag, an insert 302 of stiff sheet plastics material or cardboard is pressed into the base of the bag. A further protective sheet 304 is placed on the article A.

When the lid designated 306 is closed, the panel 18 lies on top of the sheet 304. The lid 306 of the outer enclosure has elastic corner straps 308. If there is free space in the enclosure, a further panel 310 is secured to the underside of the lid 306 before the lid is closed. The panel 310 is constructed in the same manner as the panels described above and is held in place by the elastic straps 308.

The sheet 304 can be positioned between the panels 18 and 310 instead of being below the panel 18.

A sliding clasp fastener 311 has one of its stringers 312 fixed to the edge of the lid 306 and the other, designated 314, is fixed around the upper edges of the side walling 316 of the base of the outer enclosure 300. A permanent strap 318 is secured to the side walling of the base.

The sliding clasp of the fastener has an eyelet in it. When the fastener is in its closed position the sliding clasp is adjacent the strap 318. A padlock or other securing means attaches the clasp to the strap 18. Only on removal of the securing means can the clasp be slid along the stringers to open the enclosure 300. Unauthorised opening of the enclosure can thus be detected.

An elongate loop of webbing can be provided on each side of the enclosure 300. The loops serve as carrying straps. The ends of each loop can be welded or otherwise secured to the side walling 316.

From the above description it will be understood that as there is a single air inlet and a single manifold, all the tubes are interconnected. A leak anywhere in the liner could consequently deflate the entire liner. To prevent this one way air flow control valves are provided where each tube is connected to the manifold.

The preferred form of valve comprises a length of thin flexible plastics tubing that can be completely flattened. The tubing is welded in as the liner is fabricated.

Air pressure in the manifold opens up the tubing so that air flows through to the respective tube. When the requisite pressure has been reached, supply of air is terminated. The tubing flattens under the influence of the pressure in the respective tube.

There is no pressure in the manifold once the air inlet valve is disconnected from the air supply.

The invention claimed is:

1. A shipping container comprising a liner having a plurality of panels each of which panels is constituted by a plurality of inflatable tubes, there being a row of side wall panels which, in use, stand vertically and protect the sides of the article being shipped, a base panel on one side of the row of panels and on which said article being shipped stands, a top panel on the opposite side of the row of panels to the base panel and which overlies the article being shipped, and an outer enclosure, comprising a base, side walling and a lid, into which said liner fits, said liner being between the article and the outer enclosure to provide thermal and mechanical protection, characterised in that said outer enclosure is in the form of a soft bag, there being a stiff sheet inserted into the lower part of the bag in contact with the base of the bag.

2. A shipping container as claimed in claim 1 and including a further stiff sheet in the outer enclosure between the article and said top panel.

3. A shipping container as claimed in claim 1 and including a further panel which panel also comprises inflatable tubes, said further panel being between said top panel and said lid.

4. A shipping container as claimed in claim 3, where in elastic straps are secured to the inside surface of the lid, said further panel having portions thereof between said lid and the straps and being held in place by the straps.

5. A shipping container as claimed in claim 1, wherein one edge of the lid is permanently connected to the side walling and there is a sliding clasp fastener having the stringers thereof secured to the remaining three edges of the lid and to the side walling for closing the outer enclosure.

6. A shipping container as claim in claim 5, and including releasable locking means for securing the sliding clasp of the fastener to said side walling to prevent the shipping container being opened until the locking means is released.

7. A shipping container as claimed in claim 1, and including carrying straps secured to the outer enclosure.

8. A shipping container as claimed in claim 1, wherein the liner includes a manifold to which said tubes are connected, and wherein there is a one way flow control valve between each tube and the manifold, the valves permitting air flow form the manifold to the tubes but preventing reverse air flow from the tubes to the manifold.

* * * * *